US010760173B2

(12) United States Patent
Angelini

(10) Patent No.: US 10,760,173 B2
(45) Date of Patent: Sep. 1, 2020

(54) ECOLOGIC METHOD FOR THE CONTINUOUS CHROME PLATING OF BARS AND ASSOCIATED DEVICE

(71) Applicant: ACROM S.A., Luxembourg (LU)

(72) Inventor: Giorgio Angelini, Burago di Molgora (IT)

(73) Assignee: Acrom S.A., Luxembourg (LU)

( * ) Notice: Subject to any disclaimer, the term of this patent is extended or adjusted under 35 U.S.C. 154(b) by 298 days.

(21) Appl. No.: 15/546,156

(22) PCT Filed: Dec. 18, 2015

(86) PCT No.: PCT/IB2015/059777
§ 371 (c)(1),
(2) Date: Jul. 25, 2017

(87) PCT Pub. No.: WO2016/120700
PCT Pub. Date: Aug. 4, 2016

(65) Prior Publication Data

US 2018/0016688 A1 Jan. 18, 2018

(30) Foreign Application Priority Data

Jan. 30, 2015 (IT) ..... MI2015A0128

(51) Int. Cl.
*C25D 3/06* (2006.01)
*C25D 5/08* (2006.01)
(Continued)

(52) U.S. Cl.
CPC ..... *C25D 3/06* (2013.01); *C25D 5/04* (2013.01); *C25D 5/08* (2013.01); *C25D 7/00* (2013.01);
(Continued)

(58) Field of Classification Search
None
See application file for complete search history.

(56) References Cited

U.S. PATENT DOCUMENTS 3,751,344 A 8/1973 Angelini
4,820,395 A 4/1989 Angelini
(Continued)

FOREIGN PATENT DOCUMENTS

EP 1010779 A2 6/2000
JP S63293197 A 11/1988
WO WO2008/057123 A1 5/2008

OTHER PUBLICATIONS

PCT International Search Report and Written Opinion of the International Searching Authority, PCT/IB2015/059777, dated May 19, 2017, 18 pages.

*Primary Examiner* — Stefanie S Wittenberg
(74) *Attorney, Agent, or Firm* — Fish & Richardson P.C.

(57) ABSTRACT

Method and plant for continuous chrome plating of metal bars, tubular elements and similar, wherein the bar to be chromed is made move forward fastly in a device of chrome plating without of tank of chrome plating including a plurality of anodic cells of chrome plating with tubular-torx shape, into which an electrolytic solution flows with high density of current, for forming on the bar a multi-layer chromium plating while the bar moves forward through the anodes-cells themselves, and wherein the device is characterized in feeding the electrolytic solution with a flow axially distributed and with a circulation of the electrolyte in a turbulent flow, controlled through the anode of chrome plating, said plant including furthermore many cooling stations of the bar by a jet of liquid with cryoscopic thermal step, the sealing of the bath is guaranteed by gaskets in plastic material which are reinforced by armonic steel springs.

9 Claims, 7 Drawing Sheets

(51) Int. Cl.

| | |
|---|---|
| ***C25D 7/00*** | (2006.01) |
| ***C25D 17/02*** | (2006.01) |
| ***C25D 17/12*** | (2006.01) |
| ***C25D 21/10*** | (2006.01) |
| ***C25D 21/02*** | (2006.01) |
| ***C25D 17/00*** | (2006.01) |
| ***C25D 17/10*** | (2006.01) |
| ***C25D 5/04*** | (2006.01) |

(52) U.S. Cl.

CPC ..... *C25D 17/00* (2013.01); *C25D 17/004* (2013.01); *C25D 17/02* (2013.01); *C25D 17/10* (2013.01); *C25D 17/12* (2013.01); *C25D 21/02* (2013.01); *C25D 21/10* (2013.01)

(56) References Cited

U.S. PATENT DOCUMENTS

| | | | | |
|---|---|---|---|---|
| 5,401,379 | A * | 3/1995 | Mazzochi ..... | C25D 5/12 205/100 |
| 6,200,452 | B1 * | 3/2001 | Angelini ..... | C25D 7/04 204/198 |
| 2005/0284769 | A1 | 12/2005 | Edigaryan | |

* cited by examiner

ECOLOGIC METHOD FOR THE CONTINUOUS CHROME PLATING OF BARS AND ASSOCIATED DEVICE

CROSS-REFERENCE TO RELATED APPLICATION(S)

This application is a U.S. National Phase Application under 35 U.S.C. § 371 and claims the benefit of priority to International Application Serial No. PCT/IB2015/059777, filed Dec. 18, 2015, which claims priority to Italian International Application Serial No. MI2015A000128, filed Jan. 30, 2015, the contents of which are hereby incorporated by reference.

The concepts herein refer to the deposition of hard and thick chrome on elongated metal pieces like bars, by electrolytic deposition of trivalent chromium instead hexavalent chromium.

More particularly the concepts herein refer to a process of continuous chrome plating with forced circulation, in turbulent flow, of an electrolytic solution of trivalent chromium, inside annular anodes while the metal pieces are moved forward inside them.

The chrome plating is a coating of chrome on a product in iron or steel for protecting it from corrosion, conferring to it a high resistance to abrasion thanks to high hardness of the chrome electrically deposited.

Said property of chrome plating essentially depend on the number of microscopic fissures for a given distance. In general, a structure with a high density of fissures is desirable, since it tends to have less stress, higher lubrifying power, good resistance to wear and a better resistance to the corrosion.

Furthermore the non-correspondence of the fissures provides a better protection to the corrosion, a lower permeability of the covering, since the probability of correspondence of microscopic fissures of each chrome layer tends to zero.

For obtaining the non-correspondence of the fissures and a lower permeability of the deposit, it is used the deposition of a plurality of superimposed deposits or multilayer chrome plating.

Today the multilayer chrome plating of metal bars is realized by a plurality of continuous processes that use hexavalent chromium.

Said processes can be of a static type where the electrolytic solution is placed in a tank wherein the pieces to be chromed are immersed, or of a dynamic type wherein it is provided the continuous circulation of the electrolytic solution inside of one or more annular anodes wherein are made to pass continuously the bars to be chromed that act as a cathode. An example of this last type of process is reported in the Italian patent application MI98A002595, which provides for the usage in series of particular hollow anodes through which it is fed the electrolytic solution, axially with respect to the advancing bar, dynamically and with non-turbulent flows. In said patent application it is said that thanks to this type of feeding and to this type of electrodes, it is possible to use a current density around 300 Ampere/$dm^2$.

The anode used in the aforementioned plant is of an annular type, perforated along the crown with three series of holes that determinate, intentionally, a calm surrounding environment (electrolytic solution).

Anyway, tests performed by the Applicant have shown that is only the first anode that works to said high current densities, while in the second and third anode the galvanic process does not activate at the indicated currents densities, excepting if the current density is reduced, from 300 to 70 Ampere/$dm^2$.

The Applicant has actually found that if a current density of at least 300 Ampere/$dm^2$ is used on all the three anodes, realized in lead as in the other processes that use hexavalent chromium, and operating in a chrome plating cell in lead, only after a month of work we have the deformation of the anode due to the high heat which is generated due to the high density of current, with the risk of short circuits between the anode and the cathode (bar), while for working simultaneously with the three anodes in series, we shall use a low current density of 50 Ampere/$dm^2$: this implies obviously a significant productive drawback since lower current densities imply low advancement speeds of the bar through the anode of chrome plating for having a certain thickness of deposit, slowing therefore the operational speed. The productive difference between the use of an anode instead of three anodes, as can be realized, implies a reduction of the industrial productivity of 66%.

Furthermore the process which is described in the aforementioned patent application, like as well the other known processes, is based on the usage of an electrolytic solution of hexavalent chromium that, if from one side determinates good results of chrome plating, on the other represents a considerable environmental pollution.

In the sector of continuous chrome plating is therefore highly requested the need of finding a process of hard chrome deposition that is efficient on terms of industrial productivity and that at the same time eliminates the use of hexavalent chromium so as to have a high environmental sustainability.

In particular, many national regulations (REACH regulations of the European Union and US Environmental Protection Agency) have imposed year 2017 as the deadline within which the trioxide of chromium shall be banned, also even if the legislators could allow an extension of the use thereof for a certain period of time against significant fiscal impositions and progressive and considerable reductions of volume.

The trivalent chromium is actually used for some processes of decorative chrome plating wherein it is provided the deposition of thin films of chrome (<1 micron), while up today, for what is known to the Applicant, it was impossible to perform quality-relevant deposits of hard chrome (thickness about 50-60 micron).

The scope of the concepts herein is to overcome, at least partially, the drawbacks of the known art providing a process and a plant capable of operating with high current densities, with a high industrial productivity but with a low environmental impact.

This and other scopes are obtained by the plant according to the concepts herein having the features listed in the annexed independent claim 1.

Advantageous embodiments of the concepts herein appear in the dependent claims.

An object of the concepts herein concerns the use, for obtaining deposits of thick hard chrome on elongated metal pieces like bars, of an electrolytic solution of $Cr^{3+}$ with electrolytic deposition of chromium, forced to circulate in turbulent flow in at least one anode of platinized titanium, highly perforated or micro-perforated like for example a mesh or micro-perforated net, in substitution of the hollow anodes in lead. With "platinized titanium" it is herewith identified any type of platination that can be performed on the titanium, included the platination with Niobium or other noble metals.

The Applicant has found that the aforementioned substitution of the perforated anodes in lead with those in platinized titanium—highly perforated—allows for making the three anodes of a plant like that of MI98A002595 work, also at a current density of at least 300 Ampere/$dm^2$.

Furthermore on the platinized titanium anodes the spontaneous oxidation of $Cr^{3+}$ does not take place: it has to be noted in fact that in the conventional processes based on hexavalent chromium, the anode constituted by lead or alloys thereof with Sn or Sb, further than being subject to oxidation with lead dioxide (polluting mud), determinates the oxidation to chromic acid ($Cr^{6+}$ of the ions $Cr^{3+}$ produced at the cathode, which is necessary for maintaining the ions $Cr^{3+}$ within certain values for obtaining an optimal deposit.

Substantially it is envisaged to use a bath based on trivalent chromium and catalysers in fluoride in combination with insoluble anodes, capable of keeping an electrode potential that impedes the oxidation of $Cr^{3+}$.

Furthermore in the known processes like those of MI98A002595, when anodes of reduced size and therefore small areas are used, if the anodic current density gets high, the re-oxidation of the trivalent chromium takes place at a low efficiency of current so that the amount of $Cr^{3+}$ in the electrolyte gradually increases for oxidation, compromising the optimal deposit. This takes place since the anode covers itself with a layer of lead dioxide: if this film is not formed, instead of it appears a layer of lead chromide that has the characteristic of not allowing the re-oxidation of the trivalent chromium.

The platinized titanium anodes offer a series of advantages, among which the reduction of the environmental impact (Pb is toxic), excellent workability at high current densities and therefore high penetrating power.

As a matter of fact, since the platinized titanium anodes can withstand without problems current densities which are far more higher than the known anodes in lead, it is possible to operate with high current densities necessary for obtaining a higher penetrating power of the chrome plating baths.

Furthermore, since the platinized titanium anodes do not alter in the geometric shape to the high current densities, in contrast with the known lead anodes, the distance cathode/anode do not variates, allowing therefore of reducing the space anode/cathode without issues of short-circuit, thereby determining a greater uniformity of deposit.

With the baths containing fluoride catalysers, it has been verified a better use of Niobium platinized anodes.

A further advantage of the use of platinized titanium anodes rests in the fact that the higher superficial density of holes due to their micro-perforation or meshing, allows a greater expulsion of hydrogen, that is produced in high quantity when operating with a high current density, thereby not requiring the normally required step of dehydrogenation. The high production of hydrogen in the processes of chrome plating is due to the secondary reaction at the cathode, that causes also the production of an aerosol of solution that causes an absorption of hydrogen both in the deposit and in the metal base, producing tensioning of the products which are chromated that require therefore an additional process of dehydrogenation (decarburation of the steel), which is no more necessary in the present process according to the concepts herein.

Furthermore the expulsion of hydrogen is further helped thanks to the fact that the use of the aforementioned anode in platinized titanium is preferably provided in combination with the turbulent flow circulation of the electrolytic solution with of chrome (III) base.

As a matter of fact since high current densities determinate an immediate increase of the temperature of the bath from which the efficiency and the speed of deposition depend thereto, is can be foreseen how important is the control of the temperature of the bath: the Applicant has found that, in contrast with what was affirmed in MI98A002595, a circulation with strong turbulent flows of the solution inside the perforated electrode concours with a regular deposit of chrome thanks to the fact that the turbulent flow of the electrolytic solution generates an effective cooling for the increase of the thermal exchange, with the subsequent decrease and regulation of the temperature.

The tests that were performed by the Applicant, operating with a current density of 250 A/$dm^2$, have shown that a speed of circulation of the electrolyte of 5 m/s results adequate, also if the speed of circulation of the electrolyte of at least about 2 m/s can be adopted, at a temperature of 50° C.

The aforementioned speeds are about six times higher than those which are obtained in the conventional or traditional devices that have as a limit currents with densities of 50 A/$dm^2$ in contrast with the 300 A/$dm^2$ of the new technique.

The Applicant has found that the performances cited in the patent MI98A002595 cannot be reached due to the missing control of the temperature: in fact, the sequence of bars onto which the in-line current is applied, heats due to the Joule effect and, the cooling only by air is not sufficient for dissipating fastly the heat so as to arrive to a temperature of about 50° C., excepting reducing in a non-acceptable way the performances of the system.

Furthermore the forced circulation of the electrolyte, favours the reduction of the distance anode-cathode, thanks to the rapid cooling which is performed, that consequently determinates the lowering of the ohmic resistance of the interface.

Without limiting to the theory it can be presumed that the turbulent flow determinates an intense hitting of the coating in the growth step which is due to collisions of chromium ions or of the vapours of the process: this hitting seemingly forces the molecules not perfectly adhered out of the coating and mechanically compacts the coating in its complex, thereby favouring the formation of adherent coating which are flawless.

As a solution, a base of trivalent chromium, apt to the substitution of those with hexavalent chromium base, it can be cited for example, a solution containing 300 g/l of $Cr^{+3}$ fluoride catalyser, for example a solution of 300 g/l of $Cr^{+3}$ to which it is added sodium alluminated fluoride catalyser ($Na_3AlF_6$-criolite) in the concentration of about 1.5% in weight further to small amounts of salts like strontium sulphate ($SrSO_4$) and kalium fluosilicate. These salts, that act as catalysers, have a solubility in chromic acid so as to provide a concentration of sulphide ions and fluoride ions corresponding to the ideal concentration for the deposition of the chrome. It shall be borne in mind that the solubility of these salts is function of the temperature and of the concentration of the chromic acid: these two parameters can variate in a defined interval but which is sufficiently large to allow the good result of the electrodeposition. For those features said auto regulating baths are called SRHR (self-regulating high speed). This all is not limiting to the scopes of the concepts herein and therefore other chromium (III)-based baths can be used.

It shall be noted that for maintaining the correct concentration of trivalent chromium (III) in the electrolyte that produces on the cathode, and the overcoming of the incapacity of the platinized titanium anodes of newly oxidize trivalent chromium due to their low anodic potential, have been provided, upstream of the cells of chrome plating, one or more sacrificial anodes in tin-antimony alloy (Pb—Sn—Sb) flanked by an independent rectifier that operates with a low current (50 A/dm$^2$) for allowing the chemical precipitation of the hydroxide ions that allow the dissolution of the sacrificial anode in Pb due to the application of the electric current, while the lead peroxide absorption is formed in situ. The application of the current, in fact, produces peroxide ions at the sacrificial anode and hydrogen gas at the cathode.

The hydroxide ions activate the process of anodic oxidation of lead dioxide and excite the platinized titanium anodes arranged downstream, favouring the electrolysis. A small amount of lead that added to the electrolyte is deposited on the platinized titanium anode as a peroxide of lead ($PbO_2$) and this last catalyses the oxidation of the $Cr^{3+}$ in chromic acid.

As a matter of fact the application of an electric current at a high density to the sacrificial anode allows its dissolution ($Pb+2H_2O \rightarrow PbO_2+4H++4e$).

It shall be noted that for each current density there is an optimal temperature for depositing the chrome: at high temperatures, increasing the current density an increase of the hardness is produce, while at low temperatures increasing the current density it is significantly reduced.

An example of electrolysis conditions that has allowed of obtaining thick hard chrome depositions of a good quality, using platinized titanium anodes, turbulent flow and trivalent chromium, are preferably the following:

bath temperature 50-60° C.;

current density from 200 to <500 A/dm$^2$;

electrolyte speed circulation 5 m/s.

In particular, the maximum hardness that can be obtained for all the values of current with a solution containing 300 g/l of $Cr^{3+}$ and catalysers takes place at T=50° C. At the temperature of 55° C., the hardness is equally high for all the values of current density.

Further features of the concepts herein will result more clear in the following detailed description, referred to a purely exemplificative embodiment, and therefore non-limiting, shown in the annexed figures, wherein.

Figure 1:
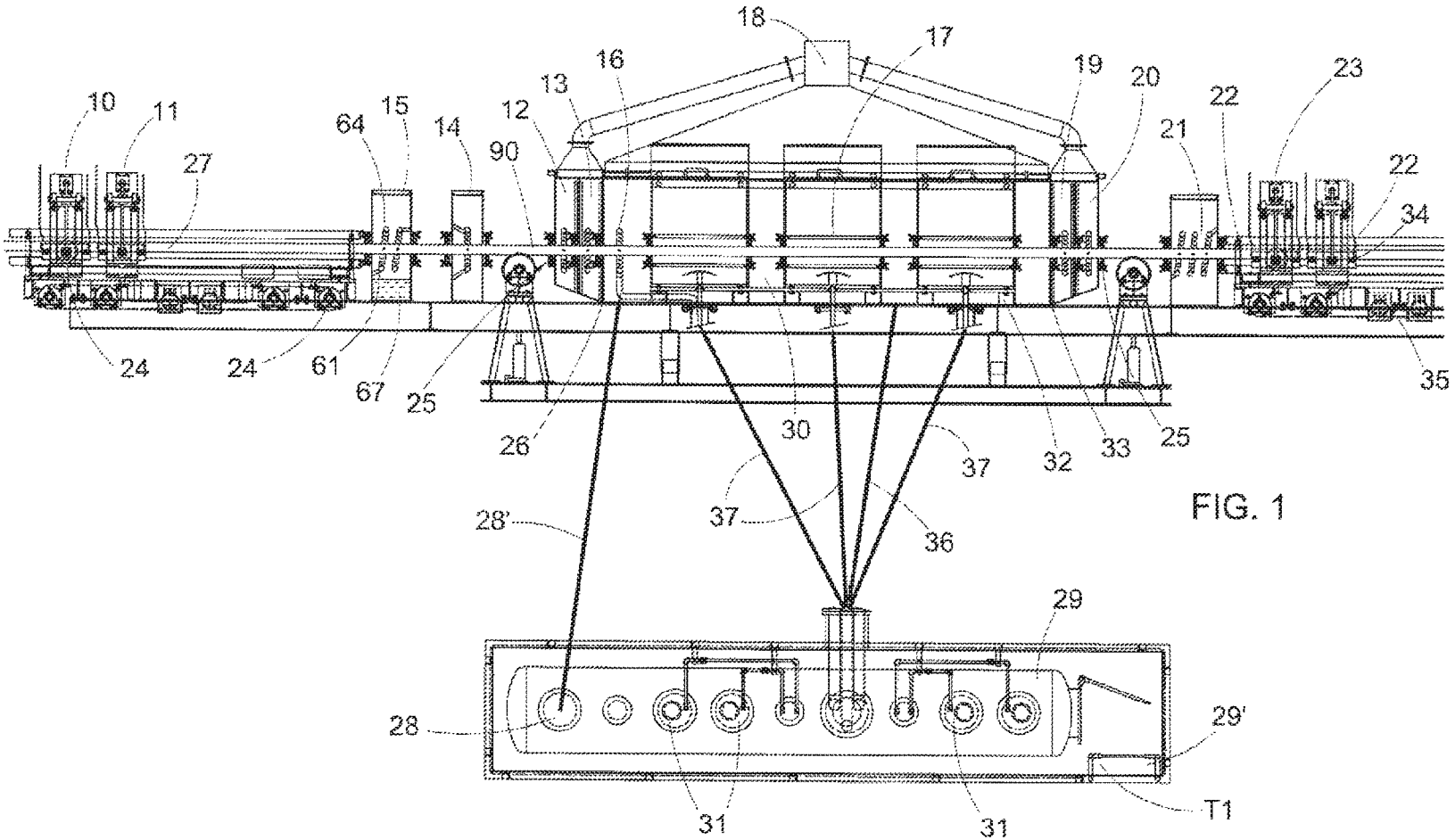
FIG. 1 is a overall schematic view of the plant of chrome plating according to the concepts herein.

With reference to FIG. 1 will now be described the features of the method and of the device (plant) according to the invention.

As it is shown in said figure, the plant principally comprises a chamber of chrome plating 30, that can have an inclined or planar bottom, wherein it is collected the electrolytic solution that exits from the anodes of chrome plating, for example three, which are internal to the chamber itself and on the whole indicated with the reference number 17, for being conveyed through the conduit 36 to a storage reservoir 29 containing an amount of electrolytic solution sufficient to allow the feeding and the continuous recirculation of the electrolyte to the anodes 17 of the device of chrome plating.

The electrolyte which is contained in the storage reservoir 29 is kept at a constant temperature, suitable for the chrome plating, that is sensed by a thermometer T1 which controls a heat exchanger 29', that intervenes for maintaining the electrolyte in the reservoir 29 to the preselected temperature. The chamber 30 on one or more lateral walls is provided with a wide window which is closed by a transparent material, for letting the process of chrome plating of the bar that takes place inside thereto to be seen; suitable water jets keep the windows clean from spurt of electrolyte.

The electrolyte which is initially contained in the reservoir 29 is composed, advantageously by a solution based on Cr (III) containing 300 g/l of $Cr^{+3}$ catalytic with fluoride: it shall be intended that also other solution based on Cr (III) can be used in the present plant and process, for example TriChrome® Plus of the Atotech or Tristar® of the Coventya. Each anode 17 is fed to the electrolyte solution, by a respective pump 31, with an inlet conduit 37, while an auxiliary pump 28 with a separated conduit allows to feed the electrolytic solution to a sacrificial anode 16, in tin antimony and lead, arranged at the inlet of said chamber of chrome plating 30, upstream respective to the anodes of chrome plating 17, for causing by the electrolytic solution itself an anodic activation (electrolytic activation not to be confused with the inversion of current used in the known processes) of the bar 27 that will trigger the adhesion of the chrome to the bar itself during the process of electrolytic deposition through the anodes 17, in the way which is described hereinafter.

Said sacrificial anode 16 is advantageously realized with a structure shaped as a ring in Pb having axial holes on the internal crown.

The chamber of chrome plating 30, in correspondence of its input wall 26 and respectively of its bar output wall 33, is further provided with cooling gaps of the bars by water jets with a lowering of the freezing point coming from a freezing plant, and of a gap with activation jets with humid air and acidulous air.

In particular, it is provided a front gap 12 of cooling by water with freezing point lowering, a gap 13 wherein are arranged humid and acidulous air jets of preparation for the electrolysis, at ambient temperature, and two rear gaps 19 and 20 with cooling jets respectively with water (coming from the cryogenic plant) and air.

The various water and air jets are suitable for cooling the bar 27 both on the inlet side and on the outlet side of the chamber of chrome plating 30, keeping it a fixed temperature suitable for the chrome plating, for example at a temperature which is comprised between 50 and 55° C., avoiding that the bar 27 overheats for Joule effect which is originated by the current that circulates in the bar itself.

Upstream of the tank of chrome plating 30, the device comprises a bar sustaining roller 24, schematically shown, by which the bars 27, suitably connected each other by intermediate joints 70, that will be shown in detail hereinafter, are moved forward and at the same time are made to rotate on themselves for enhance the homogeneity of the process of chrome deposit on the bar that moves forward through the anodes of chrome plating 17. In correspondence of the roller 24 it is provided a device 10 of linking of the bar to the negative pole (cathode contact) of a continuous current energy source, which is constituted by current-transmitting clamps which are moved by a movement, rotation and electrical connection group, which operate with the mechanical concept of the "Passo of the Pellegrino" wherein the simultaneous translation of any tool operates at a fixed step and, during the motion of the bar, an electrical contact works also when the other, which is in motion, is disconnected.

Hence it is arranged a degreasing tank 15, hereinafter described with reference to FIG. 6, and a rinsing tank with water 14 for eliminating any trace of solvent and/or surfactant of degreasing before the bar enters in the chamber of chrome plating 30.

The forward motion of the cathodic clamps 10 is impressed by a rack and pinion system: the pinion receives the motion, by an electromagnetic connector and pulleys, from the transmission shaft which is used for the rotation motion. The transmission shaft is controlled by a three-phase asynchronous motor fed by a frequency converting group. The current is transmitted to the bars to be chromed by copper clamps which are connected to a collector onto which the current is brought by copper claddings fixed to the collector. The closure pressure of the clamps is controlled by a pneumatic cylinder.

The advantage of this system is represented by the fact that it can withstand currents above 70 $A/dm^2$ while the known sliding contact, like for example that of the patent MI98A002595, cannot withstand current densities above 70 $A\,dm^2$: in fact with higher densities, for example 300 $A/dm^2$, an electric arch is formed due to the unstable connection, that causes the bonding of the copper brushes of the motor (sliding contact) with the bar in steel 27 thereby compromising completely the product.

The Applicant has found that a connection with clamps in copper that operate with the mechanical concept of the "Passo of the Pellegrino", and with the details which have been described above, avoids sparking, dispersion, superficial damages and is principally capable of operating with high current densities due to the fact that at least one contact is fixed while the other moves, and the contact which is connected in continuous current never slides. With the reference number 11, in FIG. 1, are furthermore shown the cooling air jets for the bar in correspondence of the rotating forwarding contact 10.

Upstream of the gap 12 of the chamber of chrome plating 30, it is provided a section 90 (FIGS. 1, 5) for the superficial treatment in line of the bar 27, arranged in a gap, with a protection net: said superficial treatment is performed by a circular motion with a mechanic arm and PVC-made orbiting means (peripheric speed 30 m/sec) that contain an abrasive agent (3M Scotch-Brite® by the 3M Company) and the feeding with drops for the electropolishing. Said superficial treatment provides for the mechanical reviving by the abrasive agent, with an antioxidating function by Trietanolammine 85% ($C_6H_{15}NO_3$) dissolved in water at 0.1%.

The advantage of this system is represented by the fact that the bar 27 is activated (prepared) outside the line of chrome plating with a method environmentally friendly, leaving the sacrificial anode 16 with the mere function of triggering the electrolysis of the platinized titanium anodes 17 arranged downstream, in the anode tanks.

Downstream of the chamber of chrome plating 30, immediately after the exit of the bars, it is provided a washing device 21 with water jets coming from the cryogenic plant, a second electrical connection device 23, and also a second roller 34 suitable for sustaining the chromed bars in output, allowing their unscrewing or disengagement for introducing each chromed bar 27 in a station of cryogenic cooling 35 for a time which is sufficient to cool the bars to temperatures around 50-70° C., suitable for the subsequent finishing treatments.

It shall be noted that according to the Ohm's law, for a current I where on its ends there is a voltage equal to V, there is an electric power P=V*I that is transformed in heat (Joule effect): in close contact of the electric contacts 23 and 10 on the same line of each sequence of bars about. 5.000 A with 7 Volt in CC (in total 10.000 A) are discharged, that for resistance generate an amount of heat such as to bring the outer surface (cortex) of the bar to temperature far beyond 100° C. according to the treated diameter.

Since the temperature of the bar shall be contained, maximum 50° C. for the need of the galvanic process that we bear in mind takes place at 55° C. (further cooling stations with air are arranged in points 11 and 22), the usage of cryogenically cooled water lowers the deterioration speed that increases with the temperature, resulting in a more efficient and rapid cooling respective to the air one.

With reference to the FIGS. 1, 2 and 5 will be described further features of the chamber of chrome plating 30 and of the device according to the invention.

As shown, the chamber 30 results totally sealed by peripheral walls such as to avoid the exiting of vapours and of the electrolytic solution: to this end the chamber of chrome plating 30 is connected to a suction device 18 by a conduit that brings to the scrubber of interception of fumes that recycles the chromic electrolyte, contained in the saturated vapours, in the reservoir 29.

The chamber of chrome plating 30 presents, further than the bottom wall 32, also a front wall 26 and a rear (outlet) wall 33 which are provided with wide apertures, axially aligned, for letting the bars 27 pass through. Analogous apertures are formed in positions which are axially aligned in the front walls of the gaps 12, 13, 19 and 20.

Figure 5:
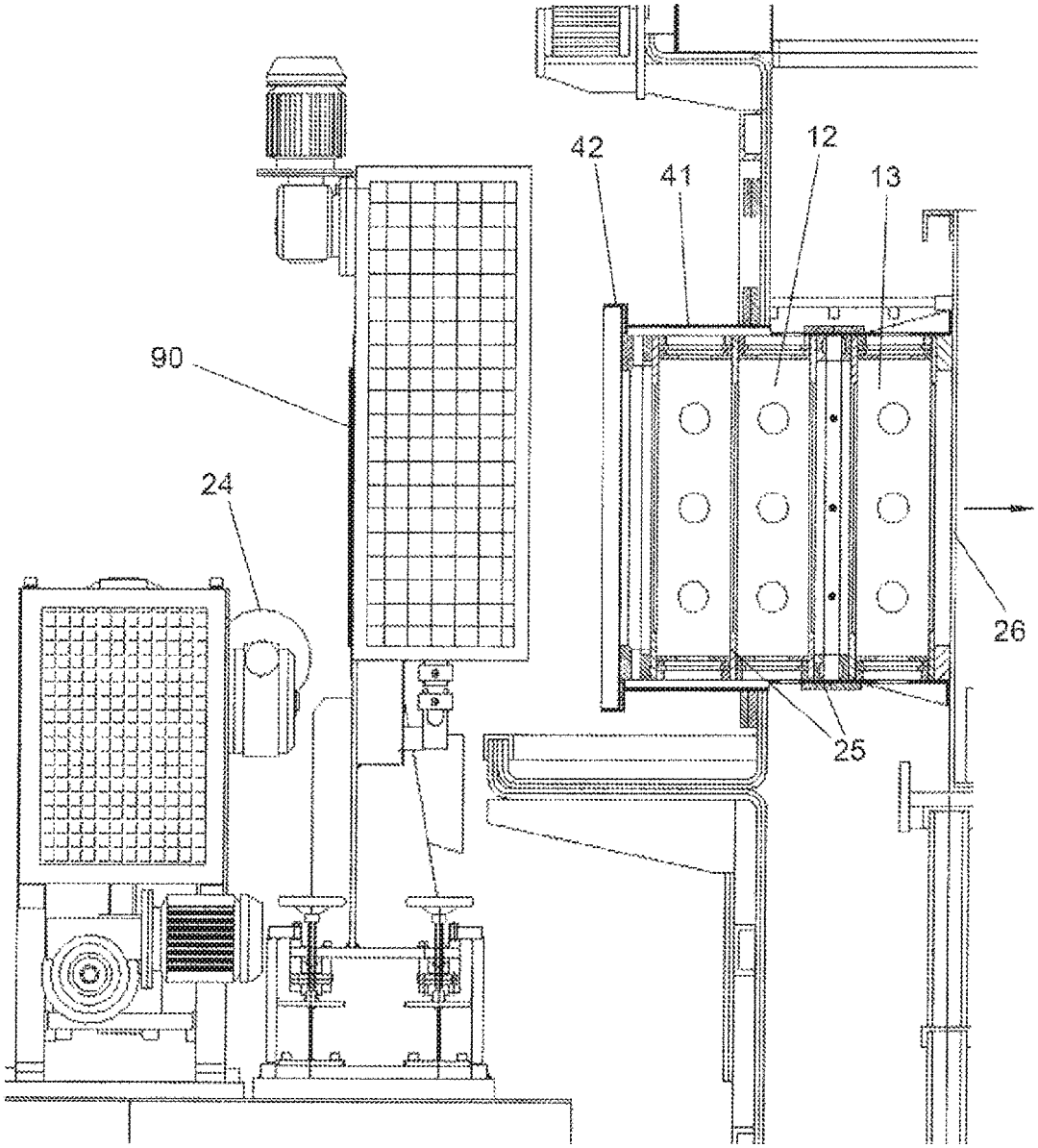
FIG. 5 is a schematic view, in a vertical section (on the right), of the sealing system provided in correspondence of the opening of input and output of the bars of the plant of FIG. 1.

Each of the apertures for the passage of the bars, in the walls of the gaps and of the chamber 30, as shown in FIG. 5, is provided with a suitable seal under the form of a flexible gasket 25, suitable for allowing the passage of the bars 27, thereby guarantying a sufficient sealing for impeding the exit of the liquid of chrome plating towards the outside.

Figure 2:
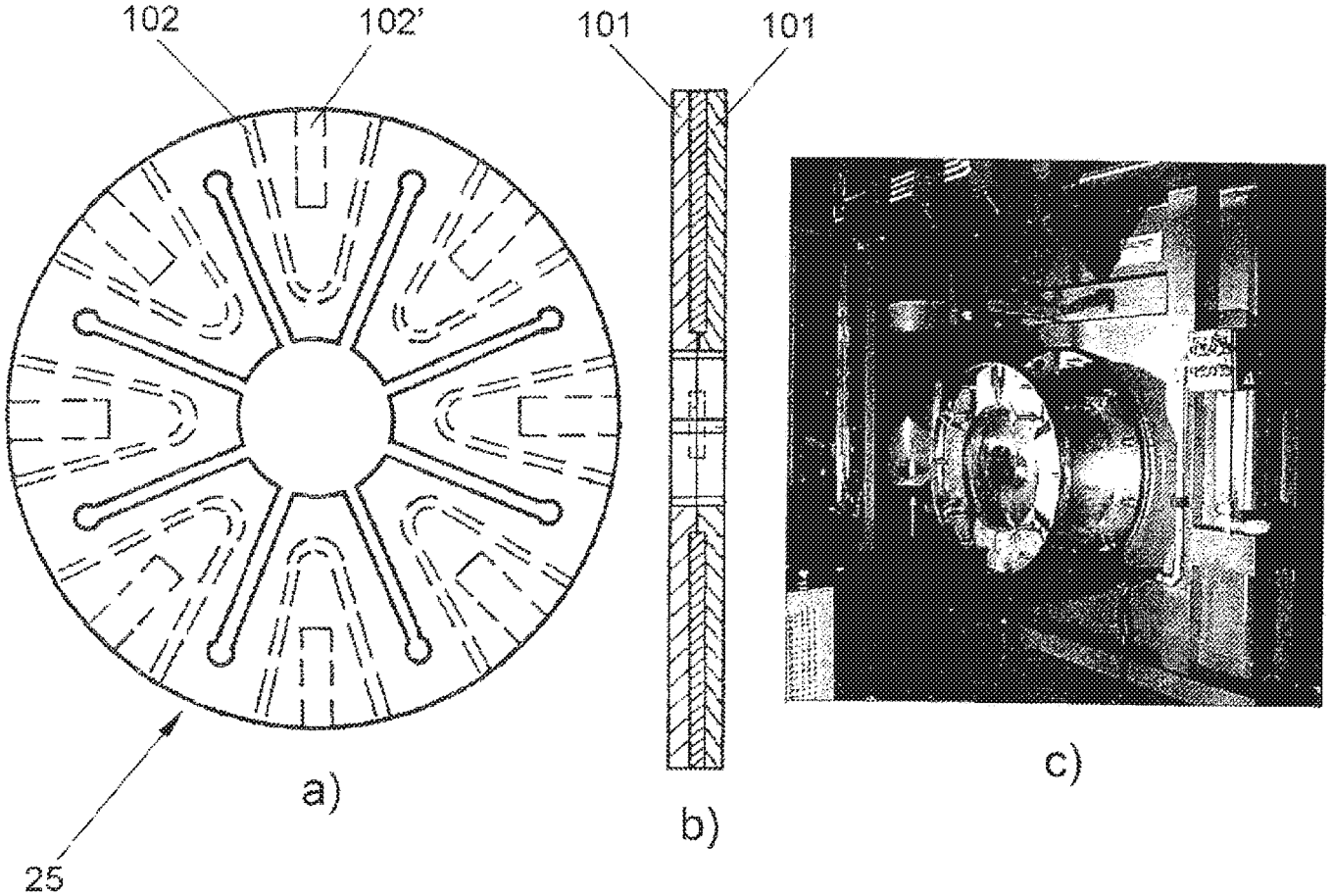
FIG. 2 shows the gasket present in the plant of FIG. 1, illustrated respectively in a front view (a), in a vertical section (b) and in perspective (c) installed in the plant.

Since the device can be apt to treat bars of different diameter, the sealing gaskets 25 FIG. 2, as shown in the example of FIG. 5, are arranged in a gasket keeping group 41 which is extractable, and kept by an external flange 42 which is solidal to the walls of the chamber 30 and functional to the gaps 12, 13 and 19, 20 (holes shown in FIG. 5 schematically illustrate holes through which water/air jets exit).

In this way is possible to extract the gaskets body 41 together with the respective gaskets 25 substituting it with a new gaskets pack configured for the passage and sealing of a bar of a different diameter. Each "gaskets pack" allows to operate on up to ten different diameters.

The sealing gasket illustrated in FIG. 2, is realized in PVC plastic, and is conveniently reinforced by radial elastic material, for example harmonic steel springs, incorporated in the gasket itself, and conveniently shaped so as to adapt themselves to different sections of the bars to be chromed. In particular, the gasket 25 is constituted by two sheets 101 of soft PVC which are pressed and bonded one another, between which radial elastic reinforcement 102, 102', under the form of steel for the flexion springs, differently arranged and oriented towards the central aperture, are fixed.

Each gasket 25 presents furthermore flexible sealing wings, defined by fissures which are directed substantially in radial direction, whose internal edges of the wings delimitate the passage of the bar, of a smaller size respective to the section of the bars themselves.

Substantially the pack of gaskets 25 constitutes a sealing device suitable for tanks of continuous chrome plating of bars or similar.

Said gaskets are arranged in correspondence of the aperture of passage of the bars on the walls of the tank of chrome plating.

Said gaskets 25 are arranged therefore as a sealing organ of the cells/anode both in input and output, allowing the turbulent flow of the electrolyte.

The advantage of this system of gaskets, introduced by the Applicant, is that not only the electrolyte but also the fumes which are saturated of solution are perfectly kept, without leakages in the working environment. The keeping of the "shutter" used in the art as for example the one described in MI98A002595 does not seal completely the tank of chrome plating, creating environmental problems.

Figure 3:
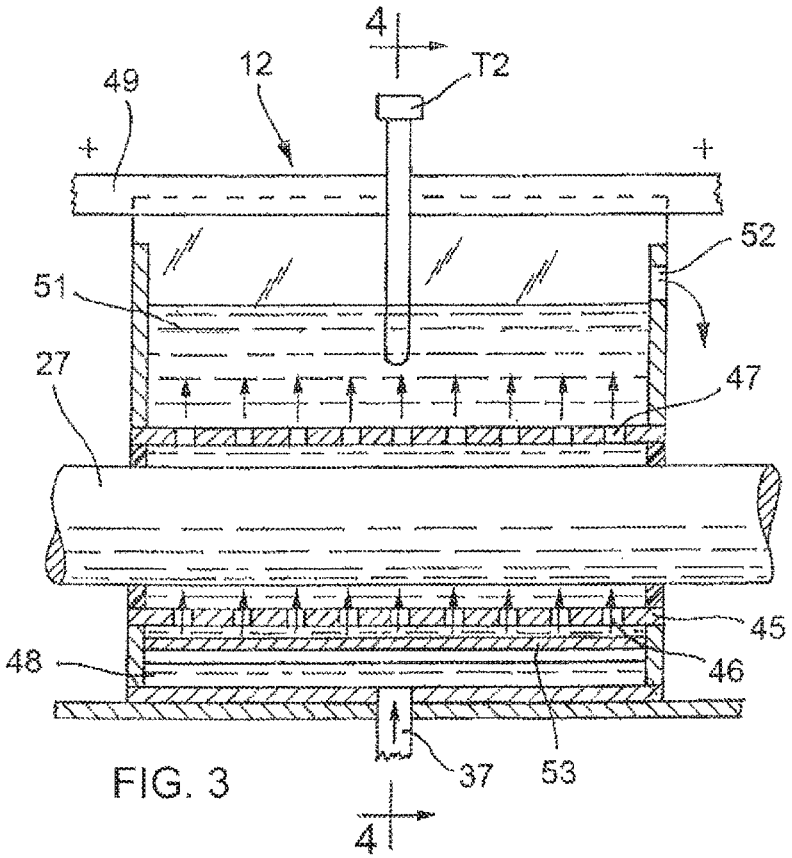
FIG. 3 shows an enlarged view of a first embodiment of a structure of anode according to the invention.
Figure 4:
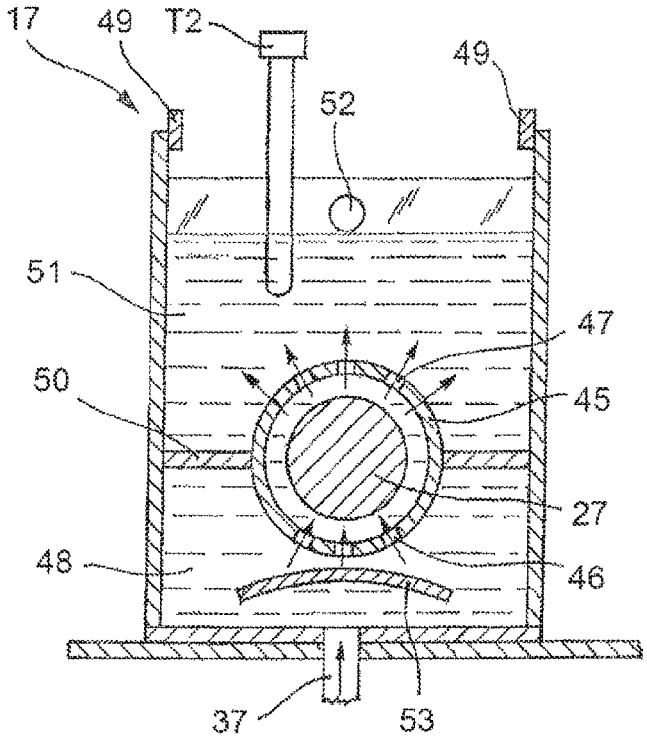
FIG. 4 is an enlarged section according to the line 4-4 of FIG. 3.
Figure 9:
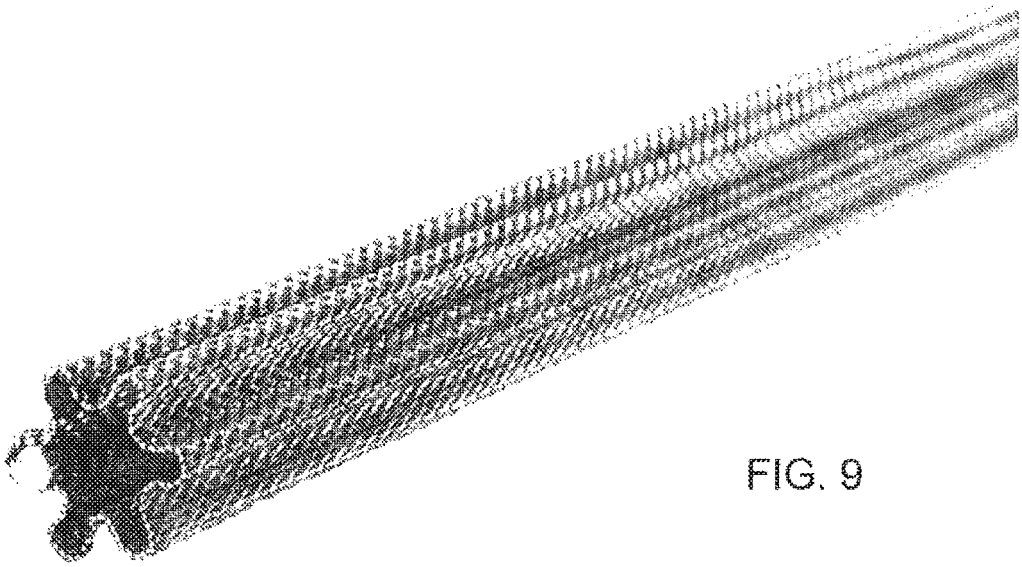
FIG. 9 is a perspective view, partially interrupted, of a second embodiment of an anode according to the invention.

Now referring to FIGS. 3, 4, 9 we will further describe with more detail the features of the anode of chrome plating according to the concepts herein.

As it can be seen in the aforementioned figures, the structure of the anode of chrome plating, indicated in its complex with the reference number 17, comprises a tubular element 45 that longitudinally extends in the direction of sliding of the bars 27.

The tubular element 45 of the anode of chrome plating, is realized in platinized titanium (hereinafter indicated with Ti PI), where generally the standard thickness of the platinum is 5 micron, while thicknesses of platinum of 20 micron where the anode is stressed are reported.

Said tubular element 45 is provided, on the bottom wall, with a plurality of holes 46 of entering of the electrolytic solution, which are distributed uniformly for the entire length of the anode of chrome plating. At the same time, the upper wall of the tubular element 45 presents in turn a plurality of holes 47 for the exit of the electrolytic solution, which are arranged uniformly for the entire length of the anode of chrome plating.

Even if in figure the number of holes 46, 47 results limited, actually the holes 46 and 47 are distributed uniformly in a number and arrangement such as to result in a tubular element preferably microforated or in a net (mesh) as illustrated in FIG. 9.

The annular element 45 of the anode of chrome plating, in its lower part, is surrounded by a chamber 48 of distribution of the flow of electrolyte and of equalization of the pressure, which is connected to pumps 31 of the reservoir 29, by conduit 37. The chamber 48 is constituted by sheets of titanium, similarly to the tubular element 45, connected to the copper bars 49 with positive polarity that conduct the current to the anode itself.

More particularly, in the example shown, the tubular element 45 is sustained by two lateral septums 50 that separate the lower closed chamber 48 that distributes the electrolytic solution to the inlet apertures 46 of the electrolytic solution in the tubular element 45 of the anode of chrome plating, towards an upper chamber 51, which is opened upwards and provided with on an own wall of a overfilling hole 52 for forming a sufficient head of liquid of chrome plating beyond the tubular element itself.

While the upper chamber 51 works for collecting the electrolytic solution that exits from the upper holes 47 of the tubular element 45 for then discharge it due to overflow through the overfilling hole 52 on the bottom of the chamber of chrome plating 30, the lower chamber 48 constitutes a sort of "plenum" or of pressurized chamber, that allows a homogeneous distribution of the electrolytic solution to the inlet holes 46, ensuring in this way that the electrolytic solution keeps for the entire length of the anode, a flow directed homogeneously from the bottom to the top, transversally to the anode itself, that is to say directed substantially in a direction orthogonal to the direction of sliding of the bar 27, enveloping two opposite sides of the bar. A deflector 53 shaped as a tile is arranged inside the chamber 48 for deviating the flow entering and avoiding the arising of preferential flows, while a thermometer T2 controls the temperature of the electrolyte that flows through the anode.

The pressure inside of the chamber 48 of distribution of the electrolytic solution, the number and size of the inlet hole 46 and of the outlet holes 47, can variate from case to case, opportunely calculated in such a way to have a turbulent introduction of the electrolytic solution and consequently an own homogeneous distribution inside of the tubular element 45. The flow from the bottom to the top of the electrolyte, in the direction wherein the bubbles of hydrogen caused by the electrolytic process of chrome plating can be produced, is anyway such as to ease the dragging and exiting of the bubbles themselves through the numerous upper holes 47 (higher density of holes with respect to the known anodes).

Figure 10:
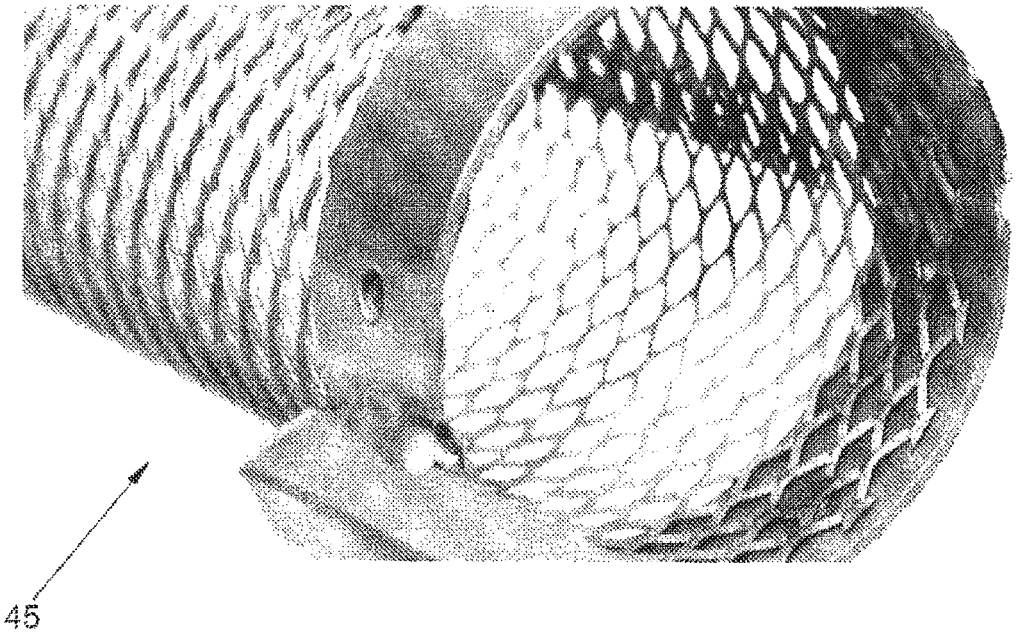
FIG. 10 is a perspective view, partially interrupted, of a third embodiment of an anode according to the invention.

The anode in platinized titanium can also be realized in a starred torx form (FIG. 10) as an alternative to the tubular version, without for this departing from the scope of the concepts herein.

In this case the anode is constituted by a support in titanium in form of a pulled sheet, with a full frame of degree "2" DIN 3.7035.

Substantially the anode used in the aforementioned plant is of an annular type, highly perforated along the crown so as to guarantee that said anode is traversed by a turbulent flow of the electrolytic solution.

Concerning the materials of the plant, all the circuitry, the structure of the anode cell, further than the reservoir are in titanium: this guarantees a better safety also in case of use of high overpressures or high vacuum levels.

It shall be noted instead that the plants that use hexavalent chromium, use lead cells, lead anodes and conduits and reservoirs in fiberglass and PVC with operative pressures close to the atmospheric pressure.

Hereinafter will be described the method of continuous chrome plating according to the invention, executable by the above described device.

The bars 27 that shall be chromed, are mechanically and electrically connected one after the other, for example by intermediate joints that can be screwed in corresponding threaded holes arranged at the opposite ends of the bars 27 (FIGS. 7-8); in this way the bars can be made translate forward towards the device of chrome plating, forcing them to rotate around their longitudinal axis, with speed of translation and of rotation which are predetermined according to the size and/or the diameter of the bars themselves to be chromed. In such a way the bars, while moving forward with constant speed, pass through the cathode contact 10, then through the degreasing station 15 wherein they are hit by a jet of cleaning liquid, for example water containing a surfactant, preferably a degreasing solution LHC/3 (Low Heat Cleaner 3™ of Chemtall), therefore pass through the rinsing tank 14.

The degreasing solution to be used shall contain a percentage of LHC/3 comprised between 3% and 8%, while the bath arrives to be exhausted when it contains 10% in concentration of LHC/3. The separation of the oil from the surfactants take place by an acid rupture, bringing the pH of the residual surfactants, that are bio-degradable, between 6.5 and 8.5.

The degreasing station 15 is generally constituted by an insulated inox steel AISI 304, with an overall capacity of 2.000 Litres.

An overfilling extractor capable of continuously extracting from the surface of the degreasing solution the floating tars is also provided. Furthermore, it is present also a filter for separating the degreaser from the solution. Some resistance (not illustrated in the figures) of a power of 6 kW, are provided for heating at the start up the degreasing solution up to the working temperature of 80° C., which is regulated by a thermostat, while cooling serpentines 67 are connected to the cryogenic station.

The washing station 14 is provided with four blade-shaped nozzles with 60° of aperture, arranged every 90° on a circumference having a diameter such as to cover the entire range of production with two bar rinsing tanks, each one provided with a floating pump for the control of the level, fed in counterflow.

Figure 6:
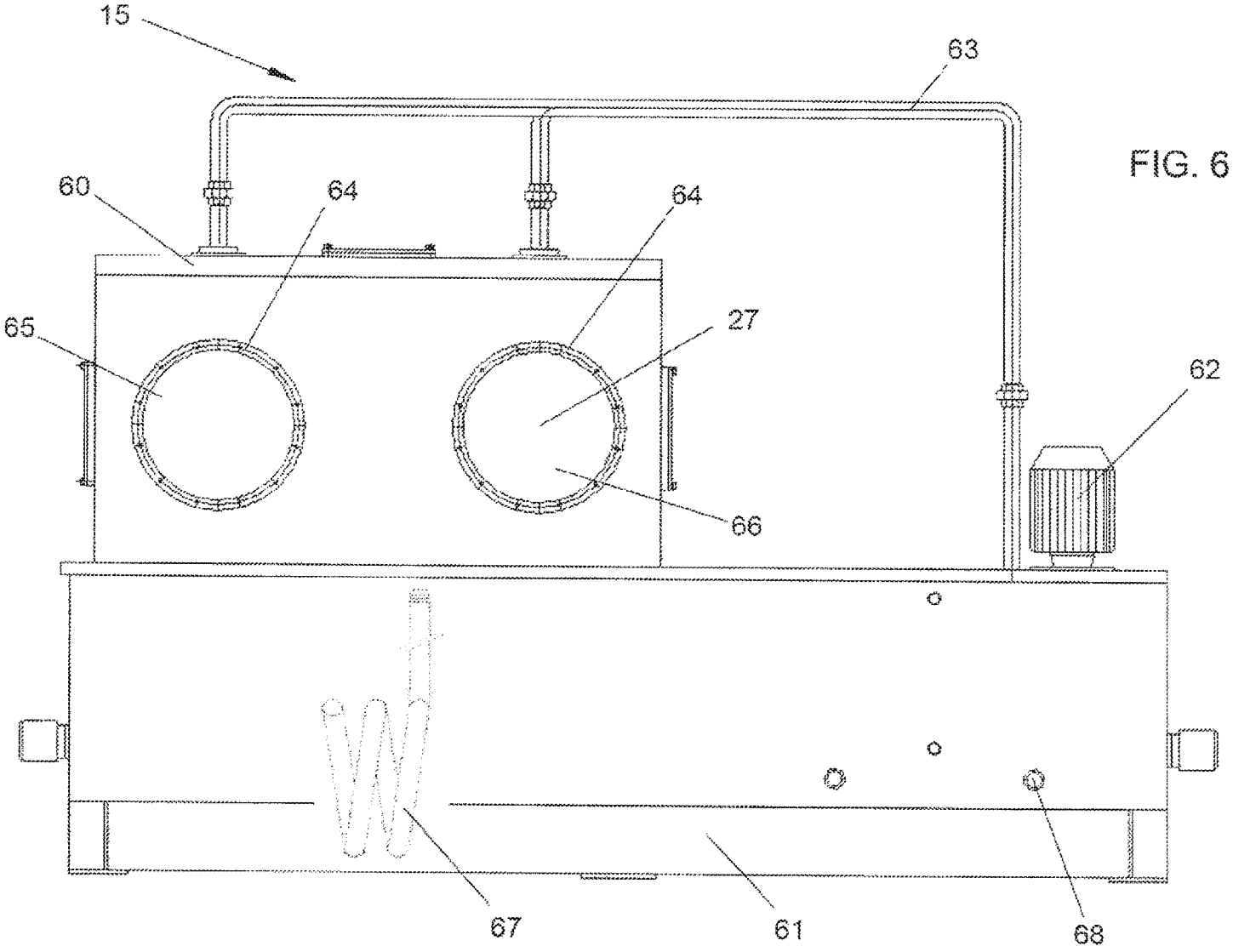
FIG. 6 is a schematic enlarged view of the degreasing section of the bars of the plant of FIG. 1.

In particular, as it is shown in FIG. 6, the degreasing station 15 is preferably constituted by a closed tank 60 containing on the bottom an amount of degreasing solution 61 that by a pump 62 and a conduit 63 is continuously fed by a spraying head 64 positioned over the bar 27. The bar 27 enters and exits from the tank degreasing 60 through appropriate openings which are formed on the two lateral walls in axially aligned positions respective to the aperture of passage of the bar in the chamber of chrome plating 30, foreseeing that appropriate sealing gaskets 65 and 66 (FIG. 6) can be identical to the gaskets 25 or can be conventional gaskets realized for example in felt. As previously said, since the bar 27 shall be thermally conditioned for avoiding its excessive overheating due to the current circulating in the bar itself so as to keep it at a temperature suitable to the step of chrome plating, before the degreasing station 15 cooling air jets 11 are arranged.

Furthermore, in the case wherein the temperature of the degreasing liquid 61 increases, exceeding a value considered dangerous, inside the degreasing tank 60, immersed in the liquid 61, is provided a suitable serpentine of cooling 67 into which a cooling fluid circulates, for example water from a fluids source 68 (conduit of the cryogenic station), having for example a thermal sound of control of the temperature of the fluid 61.

After the degreasing station 15, the bar 27 is made to pass through the washing tank 14 where the bar is hit by water jets that clean it completely before the superficial treatment 90 which is performed by a mechanical superficial reviving (with abrasive 3M Scotch-Brite®), having an anti-oxidant function by Trietanolammine 85% ($C_6H_{15}NO_3$). This treatment, external to the tank 30, can be defined as a physical-chemical etching (it is underlined the chemical-physical and not electrolytic activation) that differs from the electrolytic one generally performed by current inversion (anodic etching for 30-120 sec with the bar that acts like anode instead of cathode). All the resulting liquids (at ambient temperature) are recycled in the chromium reservoir.

It shall be noted that the inversion of polarity in the chrome plating baths conventional having base of Cr (VI) over the long-term causes the contamination of the electrolyte that causes a fall of the yield of current, due to a reduction of the conductivity of the bath, and the deterioration of the deposit features.

In the present process instead the superficial roughening of the steel of the bar for creating the conditions for a good adherence (etching) is advantageously obtained without using the polarity inversion on the bar 27.

Continuing in its motion, the bar 27 undergoes, after the cryogenic cooling by water arranged in the gap 12, to a superficial preparation with humid and acidulous air performed inside the gap 13.

Subsequently, inside the chamber of chrome plating 30, the bar 27 is at first hit by a jet of electrolytic solution fed by the pump 28 to the annular sacrificial anode 16 with holes operating as axial nozzles, realized with less noble material (lead) respective to the platinized titanium anodes that perfects a cathodic protection and promotes the triggering of the electrolysis at the following anodes 17 in platinized titanium.

Furthermore this jet finely subdivided of electrolytic solution that hits the bar 27, with the effect of the previous chemical-physical etching 90 and of the pressure of the jet itself, causes the superficial activation of the bar which is necessary for allowing a stable anchoring of the first layer of chrome when it will be deposited inside the anode or the first anode 17 of the device.

Since the nature of the material of the bar can variate, and since the superficial corrosion treatment, further than of the chemical nature of the electrolytic solution can also depend on other factors, like for example the temperature of the liquid itself and the pressure of impact of the various jets against the surface of the bar to be chromed, suitable devices for variating the pressure and/or the delivery of the liquid fed by the pump 28 shall be provided, as well as for maintaining the correctly controlled temperature conditions.

After the superficial activation zones, the bar enters in the anode 17 or in the first of a series of anodes 17, in each of which due to the electrogalvanic effect, a layer of chrome is deposited with a predefined thickness depending substantially on the parameters of the process of chrome plating and in particular on the linear speed of forward motion of the bar 27, on the ration between the diameter of the bar itself and the inner diameter of the tubular element 45 of the anode of chrome plating, as well as the superficial density of the current which is fed to the bar by the anode itself.

To this end, in order to be able to operate with high current densities, comprised for example between 150 and 500 $A/dm^2$ or above, and for maintaining at the same time high sliding speeds for the bars, for example comprised between 10 and 30 meters/hour, it is appropriate that the inner diameter of the tubular element 45 is slightly over the external diameter of the bar 27 for example about 5-20% more, since excessive distances between the bar and the anode result negative for the process of chrome plating.

A reduced distance between the surface of the bar 27 and the tubular element of the anode of chrome plating 45, further than allowing to work with higher amperages and with higher sliding speeds of the bar, allows as well a more regular deposit of chrome thanks to the fact that the flow of electrolytic solution is distributed homogeneously for the entire length of the anode of chrome plating keeping a direction from the bottom to the top; the effect of cooling of the bars, obtained in a controlled way by regulating or variating the delivery of electrolytic solution, by a feeding pump 31 with variable displacement, allows finally to increase the conditions of chrome plating and the productivity.

Since the pressure of the electrolytic solution inside of the chamber of compensation (electrolyte inlet) 46 results far longer with respect to the atmospheric pressure, it is obtained in this way a turbulent circulation of the electrolytic solution inside the anode of chrome plating, that causes a regular deposit of chrome.

The electrolytic solution that exits from the tubular element 45 through the holes 47, collects in the chamber of overfilling 51 into which spills the hole (overfilling) 52 collecting on the bottom of the chamber of chrome plating 30 for returning newly in the storage reservoir 29.

After that the anode or the complex of anodes of chrome plating 17, the bar 27, prosecuting its forward sliding, enters in the rear gap 19, where it is hit by water jets that, further than maintain the bar cooled, cause the detachment of the film of residual electrolytic solution that was left adherent to the bar itself.

At the exit of the gap 19 the bar is made pass through a gap 20 for the cooling with air, therefore dried.

The bar 27 moves forward and enters in the cooling station 21 by a water jet coming from the cryogenic plant by an annular sprayer, therefore is dried by air jets 22, before entering the station of contacts 23 and further cooled with air 22, therefore the device 23 (cathode contact) in parallel to the device 10 that connects the bar to the negative pole (cathode contact) of a source of electric energy in direct current, constituted as already said by current-bringing clamps moved by an advancement group.

The bar advances then on the output roller 34 from which is then laterally unloaded on the cooling bank 35.

In the general scheme of FIG. 1 it has been shown the use of three electrodes of chrome plating 17 arranged in series one another: anyway the number of the electrodes could also variate with respect to what is shown. The use of three electrodes of a length equal to about 33 cm, in general demonstrates to be advantageous, since it reduces the risks of contact with the bars 27 which are caused by an eventual flexion of the bar itself. Therefore according to the number of anodes which are used it will be possible to obtain, in a single passage, the deposit of one or more superimposed layers of chrome, whose thickness will substantially depend on the conditions of temperature or the delivery of the electrolytic solution that traverses the anode or each anode, as well as the inner diameter of the tubular element of the anode itself. Therefore, in function of the exigencies of use, the device can be set so as to plenty regulate the temperature and flow of the electrolyte in each anode, for example regulating the delivery of the pumps 31 in such a way to variate the conditions of cooling and of chrome plating of the bar.

The possibility of performing a continuous chrome plating on more layers, by a single passage, according to the invention results extremely important since the microscopic fissures that can be created in the deposit of a layer of chrome are closed and covered by the subsequent deposit of chrome; furthermore said possibility drastically decreases the processing times since now it is no more necessary to perform subsequent passages for a same bar through a device of chrome plating, as results nowadays necessary with the devices of a known type for obtaining greater chrome plating thicknesses.

Furthermore the concepts herein present, with respect to the conventional devices, the advantage of keeping in circulation an extremely low amount of electrolytic solution, in the order of some ten of liters per minute against the thousands of liters of electrolytic solution necessary in the conventional chrome plating devices. In this way a substantial energy and an extremely reduced processing cost are achieved.

From what has been said and shown in the annexed figures, will therefore clear that it has been provided a method and a plant for the continuous chrome plating of metal bars, tubular elements and similar, extremely versatile that uses an original structure of anode for allowing a precise control of the conditions of chrome plating, for the controlled deposit of one or more layers of chrome plating on a same bar while this advances through the anode and/or the anodes themselves. The possibility of controlling the conditions of cooling of the bar inside any anode, or therefore the conditions of chrome plating by a controlled circulation and a longitudinal distribution of the electrolytic solution while it flows transversally from the bottom to the top in each anode of chrome plating, further allows of operating with very high current densities, anyway higher than those which are possible with the conventional plants, increasing in this way the productivity.

To this end, considered the high current densities that are rendered possible with the method and the device according to the invention, with values that can variate from 150 to 500 A per $dm^2$ of surface to be chromed, according to another aspect of the invention it has been arranged a particular mechanical and electrical connection joint between subsequent bars, suitable for allowing an electrical contact over a wide surface and the passage of high current densities of chrome plating; the discussed joint furthermore allows of compensating eventual planarity defects in the trimming of the bars to be connected. In this way the problems generally connected with the overheating of the conventional joints that sometimes cause problems of fusion and its consequent bonding to the extremities of the bars to be chromed are therefore solved.

According to the concepts herein, for connecting mechanically and electrically two bars, it is therefore used an intermediate joint in deformable metal material, comprising contact surfaces with the ends of the bars, in deformable metal material, for example in copper, aluminium or other material suitable of having a degree of hardness lower than the one of the bars themselves to be chromed.

The joint is substantially constituted by a cylindrical core, having the same diameter of the bars to be chromed, provided at its ends with suitable junction engageable and disengageable for rotation, a corresponding junction, provided or formed to the opposite ends of the bars to be jointed.

Figure 7:
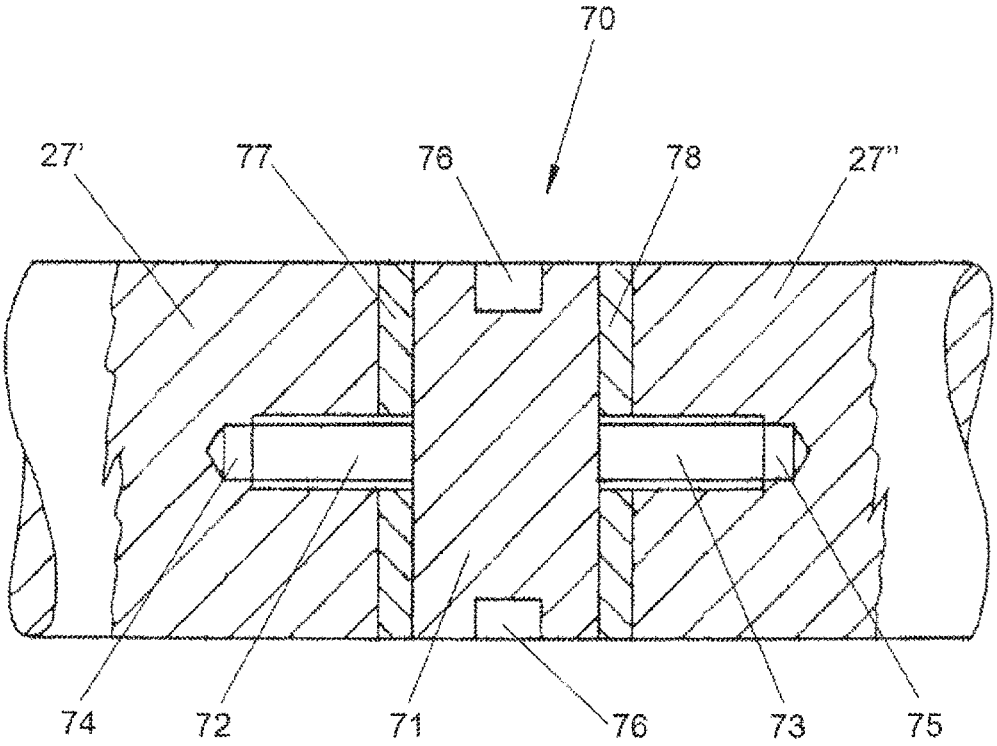
FIG. 7 is a longitudinal section showing a first embodiment of a connection joint of the bars to be chromed.

The junction can be of any suitable type; the possible embodiment of the joint is represented in the example of FIG. 7.

In FIG. 7 it has been represented the joint 70 according to the invention for connecting the two bars to be chromed 27' and 27". The joint 70 comprises a central core 71 having the same diameter or the same transversal dimensions of the bars 27' and 27", from which two threaded pins 72, 73 protrude with opposite right and left threading, suitable to screw into corresponding threaded holes 74, 75 axially formed in the opposite ends of the two bars 27' and 27". Between the central core 71 of the joint and the opposed ends of the two bars 27' and 27" has been placed a respective washer 77, 78 in copper, aluminium or other deformable metal material for facilitating the adaptation and the electrical contact between the surfaces: anyway the presence of said washers is not binding for the scopes of the concepts herein.

Since the bars 27' and 27" can sometimes present errors of trimming or planarity to their extremities, that with the conventional linking system could cause a contact in limited zones through which could pass a too high current density, such as to cause a high localized overheating and a fusion bonding of the two ends in contact with the bars themselves, according to the concepts herein it is used a joint comprising a central core 71 in soft material, having a hardness lower than the one of the bars in steel to be chromed, for example in copper, aluminium or other material suitable both for conducting the electrical current and to be subjected to a partial plastic deformation for compression during the screwing of the joint, so as to come in intimate contact and adapt against the external surface of the two bars to be jointed.

To the end of facilitating the starting and the final tightening, it is possible to foresee in the central core 71 the formation of grooves (milling) 76 for the engagement with a tightening tool. Other solutions are anyway possible for obtaining the same result.

In FIG. 7 has been shown a linking with a screw between the central core and the ends of the bars to be connected; other solutions are anyway possible, providing other mechanical and electrical contact systems.

Figure 8:
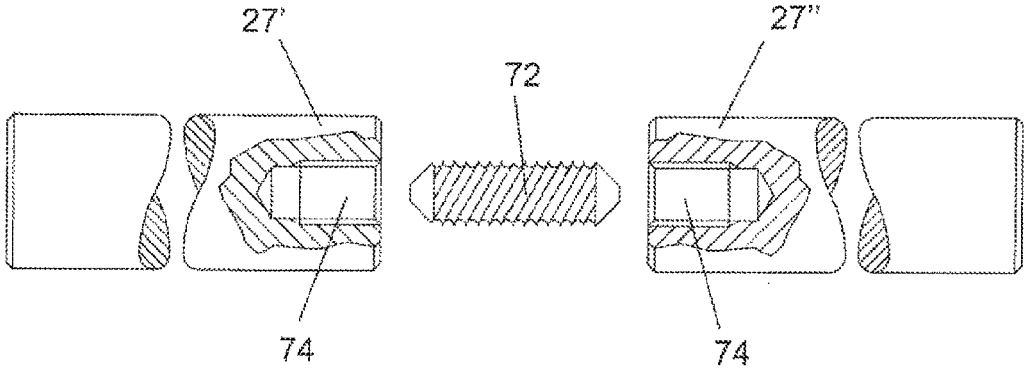
FIG. 8 is a longitudinal section showing a second embodiment of a connection joint of the bars to be chromed.

In the case wherein the bars to be connected are of a small diameter, for example from 6 to 60 mm, it is preferable to use as a connection joint a single threaded pin 72 of FIG. 8 with opposite left and right threading, suitable to screw in the corresponding threaded holes 74 and 75, axially formed in the opposite ends of the two bars 27' and 27", equivalently to what is described in relation to FIG. 7.

The advantages of the concepts herein are considerable, in particular:

higher environmental safety due to the use of $Cr^{3+}$ instead of Cr<6+>;

controlled containment of the parasitic hydrogen reaction and complete environmental safety, with the elimination of the dumps and residual disposal of the process; —better current efficiency (faradic efficiency) for the higher current density;

lower energetic costs thanks to higher faradic efficiency and the higher speed of coating;

higher quality of deposit due to the control of the morphology of coating without fragility of the steel that could be due to the hydrogen trapping, control promoting of the constant and homogeneous productive quality and better resistance to the corrosion;

lower anode-cathode distance and therefore low ohmic resistance at the interface thanks to the forced circulation in turbulent flow.

The concepts herein is not limited to the particular embodiments previously described and illustrated in the annexed figures, but to it numerous adaptations of detail can be brought, being at the level of the skilled person, without for this departing from the scope of the invention itself, as defined in the annexed claims.

The invention claimed is:

1. A plant for the continuous chrome plating of metal bars or tubular elements, comprising:

a chrome plating chamber having an input and output aperture for said metal bars or tubular elements axially aligned in the direction of motion of the metal bars or tubular elements themselves;

a roller for making said metal bars or tubular elements move forward through said chrome plating chamber;

one or more tubular anodes for chrome plating, axially aligned with the path of the metal bars or tubular elements to be chromed, each of said one or more tubular anodes comprising a plurality of surface holes, and arranged in said chrome plating chamber;

a sacrificial annular anode with holes operating as axial nozzles;

at least one pump for making a forced circulation of an electrolytic solution of chrome plating inside, respectively, said one or more tubular anodes and an auxiliary pump for making a forced circulation of an electrolytic solution of chrome plating inside said sacrificial annular anode; and a storage reservoir containing said electrolytic solution, wherein said electrolytic solution contained in said storage reservoir is a solution comprising a trivalent chromium base, and said at least one pump and auxiliary pump are configured for making said electrolytic solution circulate in a turbulent flow, said one or more tubular anodes comprising platinized titanium, said sacrificial annular anode comprising lead or alloys thereof with Sn or Sb, and being arranged at the input of said chrome plating chamber.

2. The Plant according to claim 1 wherein said chrome plating chamber comprises three tubular anodes, each fed independently by a respective pump of said electrolytic solution.

3. The Plant according to claim 1 wherein said at least one pump is a variable displacement pump.

4. The Plant according to claim 1 wherein upstream of the sacrificial annular anode and downstream of the chrome plating chamber is provided a plurality of cooling gaps for cooling the metal bars by water jets, and a gap for acidulous activation, said gap for acidulous activation being provided with activation jets configured for feeding humid and acidulous air adjacent to said cooling gap.

5. The Plant according to claim 1 wherein said sacrificial annular anode is in a form of a ring and the holes are axially distributed on an internal crown of the ring.

6. The Plant according to claim 1 wherein said one or more tubular anodes comprise a mesh, and are provided with a transversal section which is circular, oval or torx-stellar.

7. The Plant according to claim 4 wherein said chrome plating chamber, said cooling gaps and said gap of acidulous activation are connected to a suction device by conduits.

8. The Plant according to claim 4 wherein in axially aligned portions in the front walls of said chrome plating chamber of said cooling gaps and of said gap for acidulous activation, in correspondence of inlets and outlets of the metal bars or tubular elements are provided sealing elements comprising at least a flexible gasket which is reinforced by radial elastic material.

9. The Plant according to claim 1 wherein the metal bars or tubular elements to be chromed are connected mechanically and electrically to one another by an intermediate joint or threaded pins that extends axially for the screwing in threaded holes in the opposite ends of the metal bars or tubular elements to be jointed, said intermediate joint or threaded pins comprising a conductive metal.

* * * * *